United States Patent [19]

Bessett et al.

[11] 4,335,813

[45] Jun. 22, 1982

[54] CARTON FOR FRAGILE ARTICLES

[75] Inventors: Clifford H. Bessett, South Holland; Theodore H. Misdom, Lansing, both of Ill.

[73] Assignee: Packaging Corporation of America, Evanston, Ill.

[21] Appl. No.: 263,211

[22] Filed: May 13, 1981

[51] Int. Cl.[3] ..... B65D 65/16; B65D 1/00

[52] U.S. Cl. ..... 206/45.33; 229/2.5 EC; 229/44 EC

[58] Field of Search ..... 229/2.5 EC, 44 EC, 45 EC; 217/26.5; 206/45.33

[56] References Cited

U.S. PATENT DOCUMENTS

| | | | |
|---|---|---|---|
| 2,066,587 | 1/1937 | Swift, Jr. | 217/26.5 |
| 3,034,693 | 5/1962 | Cox | 229/2.5 EC |
| 3,192,050 | 6/1965 | Almquist | 206/45.33 |
| 3,258,186 | 6/1966 | Greatman | 229/45 EC |
| 3,446,417 | 5/1969 | Eisenberg | 229/44 EC |
| 3,568,914 | 3/1971 | Ahlmeyer | 229/44 EC |
| 3,570,747 | 3/1971 | McKenna et al. | 229/44 EC |
| 3,580,480 | 5/1971 | French | 229/44 EC |

*Primary Examiner*—William Price
*Assistant Examiner*—Gary E. Elkins
*Attorney, Agent, or Firm*—Neuman, Williams, Anderson & Olson

[57] ABSTRACT

A molded carton is provided for accommodating a plurality of fragile articles arranged in at least three parallel rows. The carton includes a tray section having formed therein rows of article-accommodating cells separated from one another by rows of upright posts. The rows of cells and posts are confined between elongated side walls and end walls, the latter interconnecting the side walls. The side walls have upper edge portions defining a common plane. A predetermined number of the posts extend a substantial distance above the common plane. Hingedly connected to the upper edge portions of the side walls are elongated closure flaps. Each flap, when in a closed position, is adapted to assume a substantially cantilevered relation with respect to the adjacent row of cells. Each closed flap has segments of the elongated free edge thereof supportingly engaged by the upper ends of a predetermined number of posts disposed within the adjacent row of posts.

20 Claims, 8 Drawing Figures

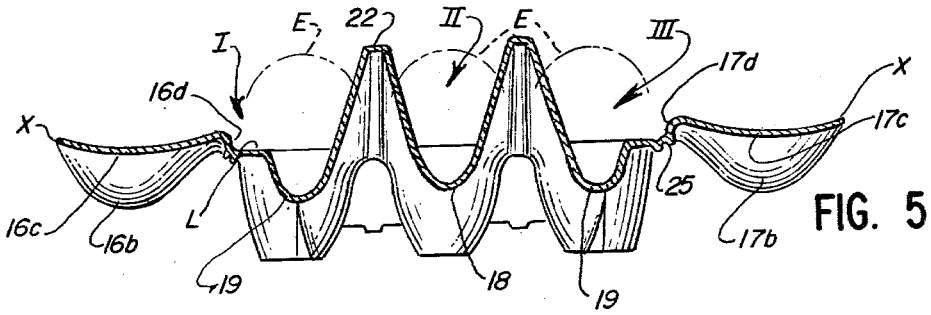
FIG. 5
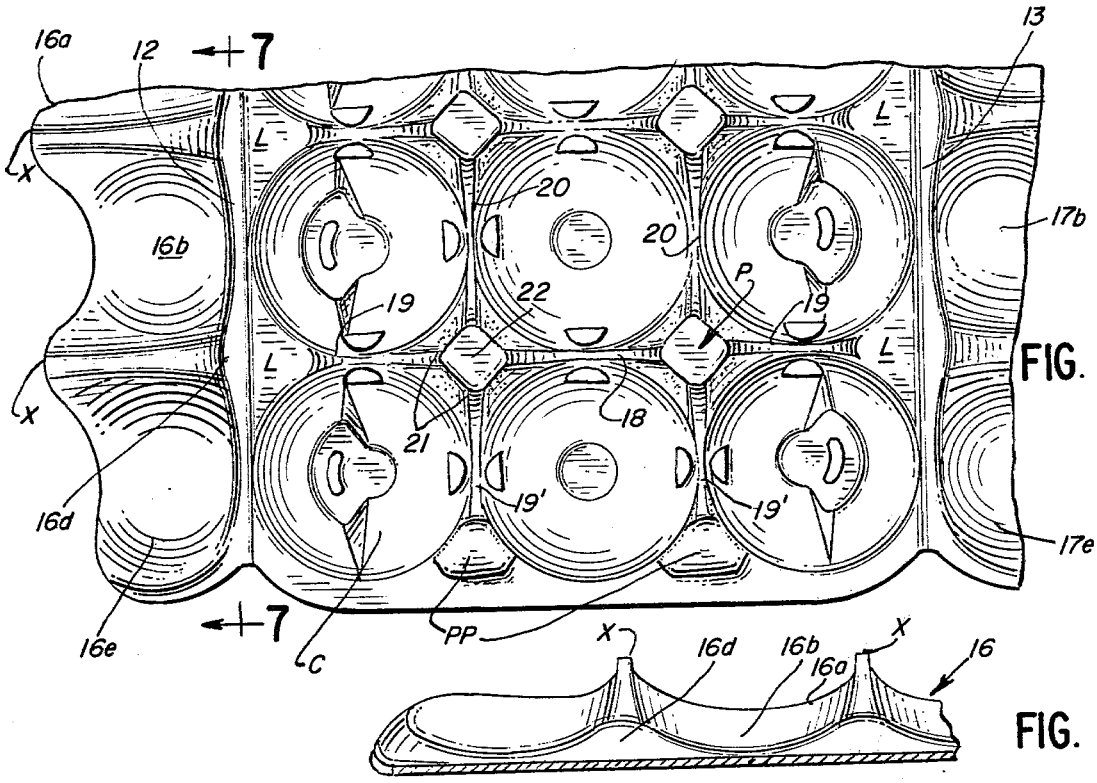
FIG. 6
FIG. 7
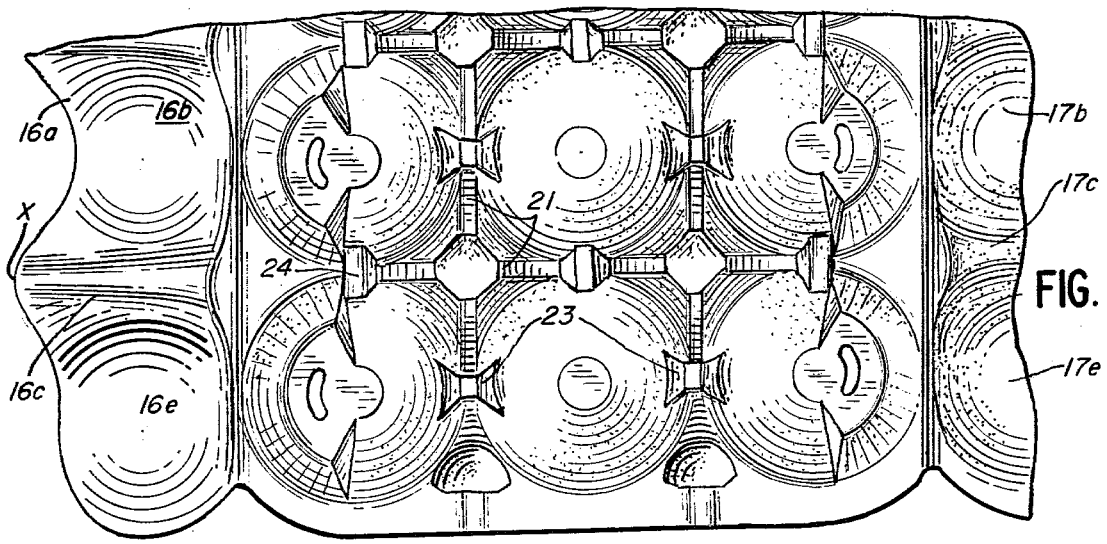
FIG. 8

CARTON FOR FRAGILE ARTICLES

BACKGROUND OF THE INVENTION

For years, fragile articles such as eggs have been customarily sold at retail in closed cartons with each carton including a cellular tray normally accommodating a dozen eggs, and a cover, or cover sections, hingedly connected to the upper edge portion of the tray. When the cover, or cover sections, were adjusted to a closed position, the eggs were substantially concealed within the carton.

Recently, however, it has become popular for retailers to merchandise eggs in quantities of more than one dozen. The increased popularity of purchasing at one time such quantities is due in part to (a) the customer seeking to make fewer visits to the retail store during a given period of time; (b) buying eggs in the larger quantities oftentimes enables the customer to take advantage of reduced sales prices when they occur; and (c) facilitates the handling and storage of such quantities.

Cartons to accommodate more than a dozen eggs have heretofore been proposed; however, because of certain inherent design characteristics, they have been beset with one or more of the following shortcomings: (1) the carton is structurally weak and does not provide adequate protection for the accommodated articles; (2) the carton is incapable of accommodating articles which vary in size over a wide range; (3) the carton, when loaded and arranged in stacked relation with other loaded cartons of like design, results in the accommodated articles supporting substantially the entire weight of the loaded cartons positioned thereabove; (4) the carton is susceptible to being tampered with and the contents thereof pilfered or damaged without this fact being readily apparent to the customer unless the customer carefully inspects the carton and its contents at the time of purchase; (5) the carton is costly to manufacture and does not have an aesthetically appealing appearance; (6) the carton is not readily capable of being loaded by conventional high-speed loading equipment; and (7) a plurality of empty cartons cannot be readily nested with one another so as to form a compact stack or bundle suitable for storage or shipment to a retailer for subsequent loading.

SUMMARY OF THE INVENTION

Thus, it is an object of the invention to provide a molded carton of the type described for accommodating fragile articles which readily avoids the aforenoted shortcomings.

It is a further object to provide a molded carton of the type described which may be readily formed on high-speed molding equipment and may be formed from a variety of moldable inexpensive materials.

It is a further object to provide a molded carton of the type described wherein the accommodated articles are protected against clicking or checking one another when the carton is being loaded or when the loaded carton is subjected to normal handling.

It is a still further object to provide a molded carton of the type described wherein the weight of loaded cartons stacked thereabove is supported entirely by the carton per se, not by the articles accommodated therein.

It is a still further object to provide an improved carton which provides good protection for the accommodated articles and yet, enables the customer to observe the accommodated articles without having to open the carton.

Further and additional objects will appear from the description, accompanying drawings, and appended claims.

In accordance with one embodiment of the invention, a molded carton is provided for accommodating a plurality of fragile articles, such as eggs or the like. The carton includes a tray section provided with at least three substantially parallel rows of article-accommodating cells separated from one another by rows of upwardly extending posts. The rows of cells and posts are confined within an area defined by elongated side walls and narrow end walls. The upper edge portions of the side walls form a plurality of lands which define a common plane. A predetermined number of posts in a row extend a substantial distance above the common plane and terminates above the tops of the articles accommodated in the adjacent cells. Hingedly connected to the upper edge portions of the side walls are closure flaps. When each flap assumes a closed position, it is cantilevered over the adjacent row of cells and segments of the free edge of the flap, opposite the hinge axis, are supportingly engaged by the upper ends of the predetermined number of posts disposed in the adjacent row of posts. The closure flaps are retained in closed positions by a means which spans the gap formed between the flaps and the distance between the end walls of the tray section.

DESCRIPTION

For a more complete understanding of the invention reference should be made to the drawings wherein:

FIG. 5 is an enlarged sectional view taken along line 5—5 of FIG. 3.

FIG. 6 is an enlarged fragmentary top plan view of the carton of FIG. 3.

FIG. 7 is an enlarged fragmentary sectional view taken along line 7—7 of FIG. 6.

FIG. 8 is an enlarged fragmentary bottom view of the carton of FIG. 6.

Figure 1:
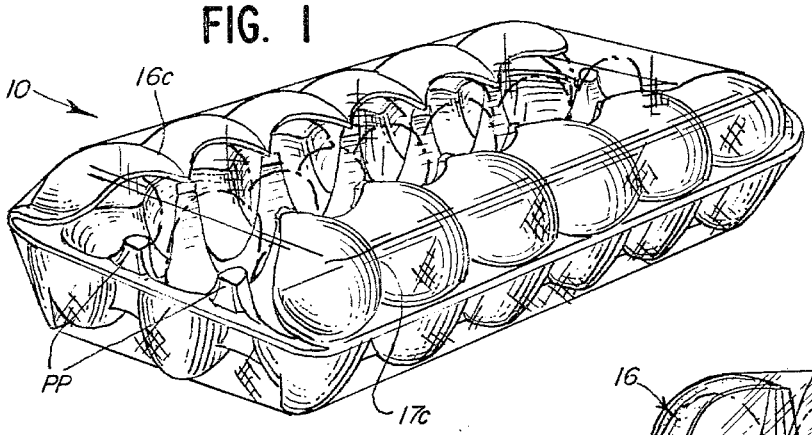
FIG. 1 is a perspective top view of one form of the improved carton shown in a fully loaded condition.
Figure 2:
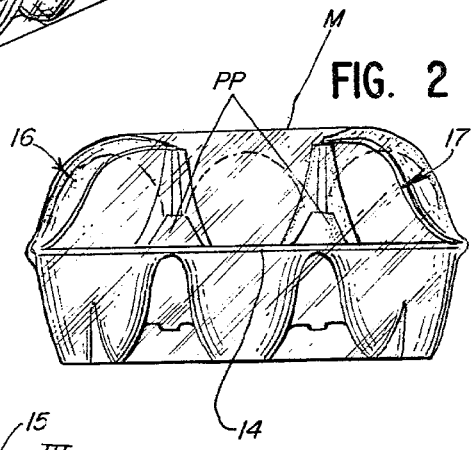
FIG. 2 is an enlarged end elevational view of the carton of FIG. 1.

Referring now to the drawings and more particularly to FIGS. 1 and 2, one form of the improved carton 10 is shown fully loaded with one and one half dozen fragile articles E (e.g., eggs). The carton, as seen in FIGS. 1 and 2, is in the condition it would normally be when purchased by a customer from a supermarket or the like. The carton 10 is preferably molded on conventional molding equipment from pulp, plastic, or like material commonly utilized in the art for molding egg cartons.

Carton 10 includes an elongated tray section 11 having formed therein at least three rows I, II, and III of cells C arranged in parallel coextensive relation. Adjacent rows of cells are separated from one another by a row IV, V of hollow posts P.

In the illustrated embodiment, each row I, II, III comprises six cells, preferably of like configuration. The configuration of the cells per se may vary from that shown and thus, the cell configuration is not a critical feature of the instant invention hereinafter described.

The rows of cells and posts are confined within an area delimited by elongated side edges 12, 13 and narrow end edges 14, 15. Hingedly connected to and substantially coextensive with the elongated side edges 12, 13 are a pair of closure flaps 16, 17; each flap being preferably of like configuration. The side and end edges of the tray section coact to form a common plane A. Each cell C is recessed a like amount from the plane A. On the other hand, in the illustrated embodiment, all of the posts P extend upwardly a like amount from plane A. The height of each post P is greater than the amount that each accommodated article projects above the common plane A. The post height is important in that it assures that the carton per se bears the weight of the loaded cartons stacked thereabove rather than the accommodated articles.

As noted in FIG. 5, adjacent cells in row II are separated from one another by a hollow saddle-shaped portion 18. Each portion is recessed from plane A and serves as a partition to prevent contact between the articles E accommodated in the adjacent cells when the loaded carton is subjected to normal handling. Similar hollow saddle-shaped portions 19 separate the cells of rows I, III and interconnect the row of posts IV, V with the adjacent side edge 12, 13 of the tray. Hollow saddle-shaped portions 20 separate corresponding cells in the adjacent rows of cells and interconnect adjacent posts in a row of posts. Similar saddle-shaped portions 19' connect the end posts of the rows IV, V to half posts PP formed on the end edges 14, 15 of the tray. The portions 18, 19, 19', 20 coact with one another to form upwardly extending convergent ribs or corners 21 for each post P. The ribs 21 serve to reinforce and stiffen each post. The upper end 22 of each post has a flat plateau-like configuration. As noted in FIG. 4, all of the post ends 22 terminate in a common plane B which is disposed in spaced substantially parallel relation with respect to plane A. It will also be noted that plane B is above the tops of the eggs accommodated in the cells C of the tray section 11.

Formed in the side edges 12, 13 of the tray section 11 and in transverse alignment with corresponding posts forming the rows of posts IV, V are enlarged lands L. The periphery of each land L has a portion thereof connected to one end of a saddle-shaped partition 19, see FIG. 5.

The half posts PP formed on the end edges 14, 15 of the tray section 11 extend from plateaus formed in the end edges and are aligned with corresponding rows of posts IV, V. The half posts PP are not intended to serve as load-bearing members like posts P, but instead merely help to reduce contact between the eggs, accommodated in the adjacent cells, during normal handling of a loaded carton or when the cells are being loaded with fragile articles. Surfaces of the posts P and half posts PP extend into and form a part of the adjacent cells.

In order to maintain the cells C in proper spaced relation, a plurality of reinforcing struts 23, 24 are formed on the underside of the tray section 11 and are integral with the exterior of adjacent cells.

Figure 3:
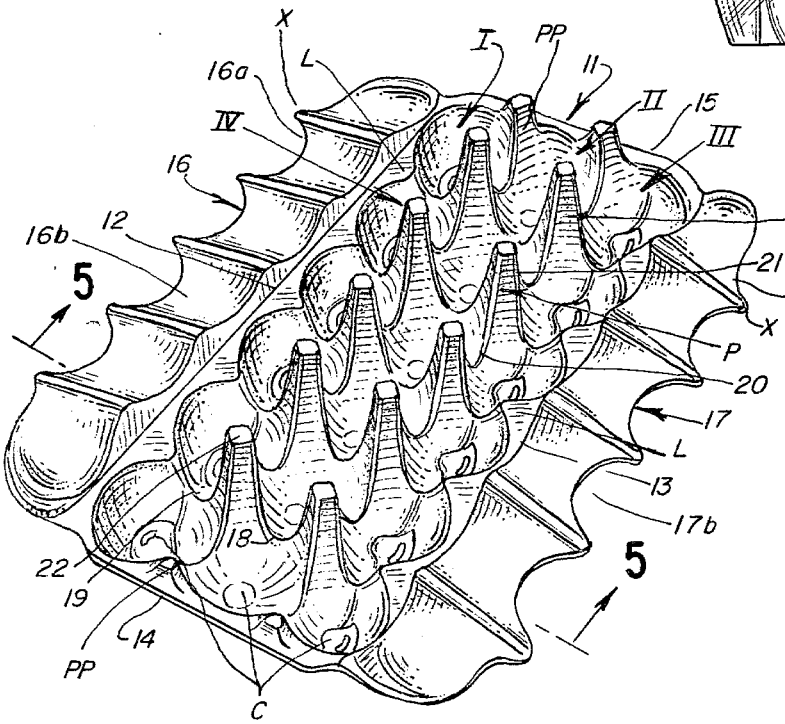
FIG. 3 is similar to FIG. 1, but showing the carton in condition for loading.

The closure flaps 16, 17, as aforementioned, are hingedly connected at 25 to side edges 12, 13, respectively and are adapted to assume an outwardly unfolded, open position, see FIG. 3, and an inwardly folded close position, as seen in FIG. 1. When the flaps 16, 17 assume an open position, all of the cells are exposed and ready for receiving the individual articles. In most commercial egg plants, the loading of the carton is done by automatic loading equipment, the operation of which is well known in the art.

Each closure flap in the illustrated embodiment is of like configuration and is substantially coextensive with the side edge of the tray section to which it is hingedly connected. The outer elongated free edge **16*a*, 17*a*** of each closure flap has preferably an undulated or scalloped configuration wherein a plurality of longitudinally spaced projections X are formed. While the number of projections X in the illustrated embodiment correspond to the number of posts in an adjacent row, the number of projections, however, may be less if so desired.

Figure 4:
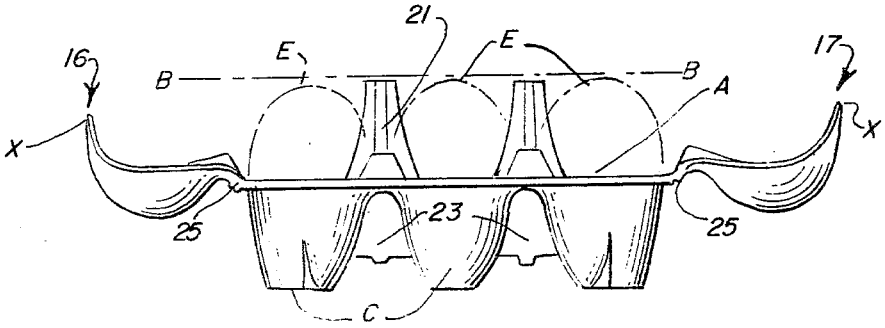
FIG. 4 is an enlarged end view of the carton as shown in FIG. 3; articles in phantom lines are shown accommodated in the carton cells.

As will be observed in FIGS. 4 and 5, each closure flap is curved a substantial amount, so that when the flaps assume a closed position, see FIGS. 1 and 2, the projections X will rest upon and be supported by the upper ends 22 of the posts P. In order to enable the projections X to engage the upper ends of the posts without the flaps 16, 17 crushing or disturbing the articles accommodated in the adjacent row of cells, each flap is provided with a plurality of longitudinally spaced outwardly protruding bays **16*b*, 17*b***. Each bay presents a concave surface which is adjacent the accommodated article, when the flap assumes its closed, cantilevered position.

Adjacent bays in a flap are separated from one another by a valley-like portion **16*c*, 17*c*. The end of the valley-like portion adjacent the hinge-axis 25 of the flap forms a shoulder 16*d*, 17*d* which is adapted to abuttingly engage a corresponding land L when the flap assumes a closed position. The shoulders 16*d*, 17*d* and the valley-like portions 16*c*, 17*c* coact with one another to provide substantial rigidity for each flap. In addition, the bays formed in each flap significantly enhance the resistance of the flaps to crushing when the loaded carton is being manually manipulated by the customer or retailer. The shoulders 16*d*, 17*d***, when abutting the lands L, limit the extent to which the flap will cantilever over the accommodated articles disposed in the adjacent row of cells.

The end bays **16*e*, 17*e*** of each flap partially conceal and protect the articles accommodated in the end cells of the adjacent row of cells.

Once the carton has been fully loaded with the fragile articles, the closure flaps are moved, preferably by automatic or semi-automatic equipment, to their closed position and then the closed carton is enveloped by a plastic membrane M. The membrane may be heat-shrunk or vacuum formed about the carton and securely holds the flaps in their closed position, and also prevents the articles, accommodated in the center row II of cells, from being accidentally removed therefrom. The membrane is preferably transparent so as to enable the customer to readily observe the contents of the carton without the latter having to be opened. To open the carton and provide access to the articles merely requires the membrane to be torn by the customer running a fingernail along the gap formed between the free edges of the closed flaps.

While the membrane M has heretofore been described as completely enveloping the carton, it may, however, merely overlie and be secured to the exposed surfaces of the closed flaps 16, 17 so as to span the gap formed in the latter.

The posts P and half posts PP, the cells C and the flaps 16, 17 are of such configuration that like cartons, when in the unloaded condition shown in FIG. 3, may be readily nested with one another so as to form compact stacks whereby such stacks are convenient for storage and shipment in bulk.

As shown in the illustrated embodiment, the free edges 16*a*, 17*a* of the flaps, when the latter are in the closed position, do not project over the center row of cells II. If desired, the free edges of the flaps may be varied from that shown so that portions thereof intermediate projections X will extend partially over the center row of cells II and form a gap between the free edges of the flaps which will not permit an accommodated article to pass therethrough when the flaps assume the closed position.

Furthermore, it is not essential that all the hollow posts P are of the same height and terminate above the tops of the accommodated articles; but, that only a predetermined number of posts have such a height. The number of posts having such a height will depend upon the length of the tray section; the number and arrangement of the cells formed therein; and the load-bearing capability of the carton required.

While the improved carton is shown with eighteen article-accommodating cells C, the number, shape, and size thereof may vary and will depend upon the type of articles to be accommodated therein.

Thus, it will be seen that an improved carton has been provided which is of simple, inexpensive construction, and yet, facilitates the handling and storage of fragile articles.

We claim:

1. A molded carton for accommodating a plurality of fragile articles arranged in at least three rows disposed in substantially parallel side-by-side relation, said carton comprising a tray section having front and rear walls interconnected to one another by end walls, the upper edges of said front and rear walls defining a common plane; and a pair of closure flaps hingedly connected to the upper edges of said front and rear walls; said tray section including rows of article-receiving cells disposed substantially parallel to and coextensive with said front and rear walls, each pair of adjacent rows of cells having a row of upright posts disposed therebetween, a predetermined number of posts in a row extending a substantial distance above said common plane; each closure flap having an edge thereof opposite the hingedly connected portion provided with longitudinally spaced segments supportingly engaged by the upper ends of the predetermined number of posts in an adjacent row of posts when said closure flap is adjusted to a substantially cantilever close position relative to the cells in an adjacent row.

2. The carton of claim 1 wherein all the posts in a row and which are disposed between the end walls extend upwardly a substantially like amount and the upper ends thereof supportingly engage corresponding segments of the adjacent flaps when the latter assumes the close position.

3. The carton of claim 1 wherein the upper edges of said front and rear walls form longitudinally spaced lands, corresponding lands being in opposed substantially aligned relation and extending towards one another, the alignment of said corresponding lands forming an axis extending transversely of the rows of cells and between adjacent cells in a row.

4. The carton of claim 3 wherein corresponding posts of the rows of posts are aligned with a transverse axis formed by opposed lands.

5. The carton of claim 4 wherein each post has an exterior surface portion extending below the common plane and forming a segment of an adjacent cell.

6. The carton of claim 5 wherein adjacent posts in a row of posts are interconnected by a first saddle portion, the latter being recessed from the common plane.

7. The carton of claim 6 wherein corresponding posts in adjacent rows of posts are interconnected by a second saddle portion, the latter being recessed from the common plane.

8. The carton of claim 7 wherein a post and an adjacent land aligned therewith are interconnected by a third saddle portion, the latter being recessed from the common plane.

9. The carton of claim 8 wherein the first, second, and third saddle portions are recessed a substantially like amount from the common plane.

10. The carton of claim 3 wherein each closure flap is provided with a predetermined number of shoulders disposed adjacent the hinge axis of said flap; each shoulder abutting an adjacent land when said flap assumes a close position.

11. The carton of claim 3 wherein the upper edges of the end walls form plateaus, each plateau being provided with an upwardly extending half post, each half post being aligned with a row of posts.

12. The carton of claim 11 wherein the elevations of the predetermined number of posts in a row are greater than the elevations of the half posts.

13. The carton of claim 12 wherein each half post has an exterior surface portion extending below the common plane and forming a segment of an adjacent cell.

14. The carton of claim 13 wherein a half post and an end post of a row of posts are interconnected by a fourth saddle portion, the latter being recessed from the common plane.

15. The carton of claim 1 wherein each closure flap, when in a close position, substantially overlying the cells of an adjacent row and the articles accommodated therein.

16. The carton of claim 10 wherein the number of shoulders formed in a closure flap correspond to the number of adjacent lands.

17. The carton of claim 16 wherein the portions of each closure flap intermediate adjacent shoulders form outwardly curved bays, each bay being aligned with a cell of an adjacent row of cells.

18. The carton of claim 1 wherein each post is hollow and the exterior surface thereof is tapered; each cell having tapered interior and exterior surfaces, whereby like cartons may assume a nested relation when the closure flaps of each carton are outwardly folded.

19. The carton of claim 1 in combination with means coacting with said closure flaps to retain the latter in said close positions.

20. The carton of claim 19 wherein the means includes a substantially taut membrane secured to the closure flaps and spanning the distance therebetween when the flaps are in the close positions, said membrane substantially spanning the distance between the end walls of said tray section.

* * * * *